US007743479B1

(12) United States Patent
Torres et al.

(10) Patent No.: US 7,743,479 B1
(45) Date of Patent: Jun. 29, 2010

(54) METHOD OF TENSIONING A WALL STRAP ON A METAL WALL

(75) Inventors: Michael Torres, Raleigh, NC (US); Robert W. Herrmann, Raleigh, NC (US); James E. Herrmann, Raleigh, NC (US); Aaron M. Herrmann, Raleigh, NC (US); Edward R. diGirolamo, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 14 days.

(21) Appl. No.: 12/237,932

(22) Filed: Sep. 25, 2008

Related U.S. Application Data

(62) Division of application No. 10/988,032, filed on Nov. 12, 2004, now Pat. No. 7,685,788.

(51) Int. Cl.
*B23P 11/02* (2006.01)

(52) U.S. Cl. ..... 29/446

(58) Field of Classification Search ..... 294/446, 294/452, 428, 897.32, 897.34, 436, 450; 52/573.1, 291, 167.3, 657, 223.14, 223.13; 254/243, 245, 246, 248, 250–252
See application file for complete search history.

(56) References Cited

U.S. PATENT DOCUMENTS 596,377 A 12/1897 McNeill
905,751 A 12/1908 Rogers
1,262,301 A 4/1918 Blest
1,338,096 A * 4/1920 Richardson ..... 254/245
1,355,389 A 10/1920 Lewis
2,591,352 A 4/1952 Harbison
2,779,980 A 2/1957 Rhodes
5,762,455 A 6/1998 Long
6,170,202 B1 1/2001 Davoodi et al.
6,185,898 B1 2/2001 Pratt
6,941,718 B1 9/2005 diGirolamo et al.

* cited by examiner

*Primary Examiner*—John C Hong
(74) *Attorney, Agent, or Firm*—Coats & Bennett, P.L.L.C.

(57) ABSTRACT

A wall strap tensioner for tensioning a wall strap of a metal wall. The wall strap tensioner includes first and second links pivotally connected together. A fastener is secured to each of the first and second links for engaging and fastening to the wall strap. Disposed about the opposite end of the tensioner is a flexible cable adapted to be secured to a portion of the metal wall. A connector connects to the flexible cable and a handle is pivotally connected to the connector and movable between first and second positions. A connecting link extends between the first and second links and the handle, the connecting link including third and fourth links that are movable with respect to each other and which are movable between retracted and extended positions. A spring extends around the third and fourth links and biases the third and fourth links towards an extended position.

17 Claims, 5 Drawing Sheets

METHOD OF TENSIONING A WALL STRAP ON A METAL WALL

CROSS REFERENCE TO RELATED APPLICATION

This is a divisional of U.S. patent application Ser. No. 10/988,032 filed Nov. 12, 2004. The disclosure of this patent application is incorporated herein by reference.

FIELD OF THE INVENTION

The present invention relates to light steel framing structures and more particularly, to an apparatus and method for tensioning a strap that forms a part of a metal wall structure.

BACKGROUND OF THE INVENTION

Metal wall sections are commercially fabricated and delivered to construction sites for erection. Typically metal wall sections include upper and lower channel sections and a series of spaced apart metal studs extending between the upper and lower channel sections. In some cases, columns are provided about opposite end sections of the wall. Further, in some cases, the corner areas of the metal wall section are reinforced.

In many cases, it is advantageous to provide additional structure rigidity by incorporating one or more bridging members or by utilizing diagonal strapping. Diagonal straps provide rigidity to the wall section as a whole. When used in prefabricated modular wall sections these diagonal straps extend from opposed corners and cross about a center area of the wall section. Diagonal straps have applications in places other than in prefabricated wall sections. Diagonal straps are also used in conventional built-in-place modular walls.

One of the difficulties in providing prefabricated metal wall sections or conventional built-in-place metal walls with strapping is that it is difficult to effectively and efficiently tension the respective straps. First it is difficult to tension the straps manually using conventional tools. Even in cases where a great deal of care and patience is exercised, the straps are not typically fully tensioned, and accordingly, the metal wall, as a whole, lacks the desired rigidity.

Therefore, there has been and continues to be a need for an apparatus and method for efficiently and effectively tensioning and securing wall straps to sections of a metal wall.

SUMMARY OF THE INVENTION

The present invention relates to a wall strap tensioner for tensioning a wall strap of a metal building. The wall strap tensioner includes a linkage assembly having opposed first and second end portions. One or more fasteners are disposed on the first end portion for connecting the tensioner to the metal strap. The second end portion of the linkage assembly includes one or more connectors for connecting the tensioner to a structure other than the strap. The tensioner normally assumes an extended position, but is operative to be moved from the extended position to a retracted position such that the effective length of the tensioner is reduced. Further, the tensioner includes an actuator for moving the tensioner from the extended position to the retracted position so as to decrease the effective length of the tensioner.

The present invention also entails a method for tensioning a metal strap of a metal wall or wall section. This method includes attaching one portion of the tensioner to the wall strap and attaching a second portion of the tensioner to a structure or a portion of the metal wall other than the strap. Further, the method entails decreasing or shortening the effective length of the tensioner so as to tension the wall strap. After tensioning the wall strap then the wall strap is secured to the metal wall.

Other objects and advantages of the present invention will become apparent and obvious from a study of the following description and the accompanying drawings which are merely illustrative of such invention.

DESCRIPTION OF EXEMPLARY EMBODIMENT

Figure 7:
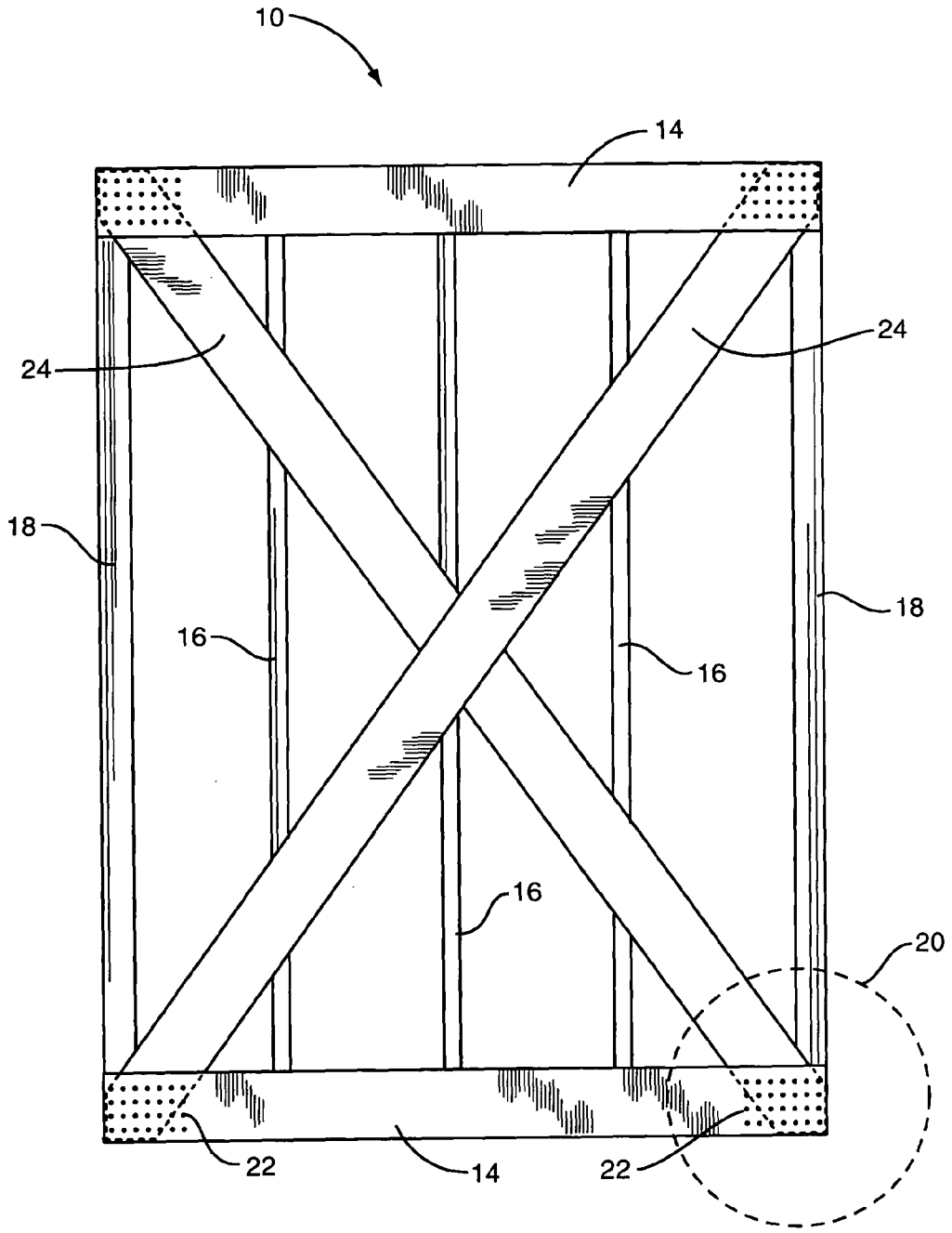
FIG. 7 is a side elevational view showing a metal wall section with two wall straps that have been tensioned and secured to the metal wall.

With further reference to the drawings, a metal wall section is shown therein and indicated generally by the numeral 10. See FIG. 7. Metal wall section 10 includes an upper channel 12 and a lower channel 14. Extending between the channels 12 and 14 is a series of metal studs 16. Disposed on opposite ends of the wall section 10 is a pair of columns 18. Columns 18 can comprise a special column structure designed to impart substantial rigidity to opposite ends or sides of the wall section. In some cases the columns 18 can be single studs, like the studs 16 referred to above, or can be a double stud arrangement. When the wall section 10 is formed, there will be defined a series of corner areas that are indicated by the numeral 20. As seen in FIG. 7, within the corner area 20 several components of the wall section come together and are joined. For example, in the corner area 20 illustrated in FIG. 7, the column 18 as well as one of the studs 16 connect to the lower channel 14. In addition, the wall section 10 is provided with a pair of diagonal straps 24. Each strap 24 includes terminal end portions that connect into the wall section 10 within a corner area 20. Metal straps 24 are conventional. They are typically secured to a portion of the upper or lower channels 12 or 14 or to some reinforcing structure associated therewith by sheet metal screws or other suitable fasteners. In conventional fashion, straps 24 reinforce the metal wall section 10 and in the case of the FIG. 7 design, tends to prevent the studs 16 and columns 18 from swaying or moving left to right.

In the FIG. 7 embodiment, a prefabricated metal wall section 10 is provided. Wall section 10 can be fabricated in a factory or plant and shipped to a construction site where the wall section or a series of like wall sections can be erected to form a wall structure or a part of a wall structure for a building. While the wall section 10 shown in FIG. 7 is in the form of a prefabricated wall section, it will be appreciated that conventional built-in-place wall sections of various length can be formed on site. Such construction can also utilize cross bracing straps 24.

The present invention deals with a method of tensioning the straps 24 and an apparatus or device for performing the tensioning. A wall strap tensioner is illustrated in FIGS. 1-6 and indicated generally by the numeral 40. As will be appreciated from subsequent portions of this disclosure, tensioner 40 is designed to be secured to a portion of a strap 24 and to be further anchored to a stationary structure or to a portion of the metal wall 10. Once secured to the strap 24, tensioner 40 can be actuated to tension the strap. Basically, tensioner 40 is designed to pull on the strap 24 and to hold the same in tension after which one end portion of the strap is fastened to the metal wall section 10. Generally, when the tensioner 40 is actuated, the effective length of the tensioner decreases and as the effective length decreases, the tensioner acts on the strap 24 and pulls the same taut.

As the drawings illustrate, the tensioner 40 disclosed herein is a compound linkage, meaning that it comprises multiple links. It includes a first end portion and a second end portion. As seen in the drawings the first end portion attaches directly to the strap 24 while the second end portion attaches to a stationary structure such as the corner area 20 of the metal wall section 10. The compound linkage that forms the tensioner 40 is designed to normally assume an extended position shown in FIG. 5, but is movable to a retracted position shown in FIG. 6. Note in FIG. 5 where the length of the tensioner is referred to as L1 while in the retracted position shown in FIG. 6, the length is referred to as L2. In the retracted position the tensioner length L2 is less than the original extended length of L1 shown in FIG. 5.

Turning to FIGS. 1-6, the tensioner 40 includes a pair of links, a first link 42 and a second link 44. Links 42 and 44 are pivotally connected by a pivot pin 104.

Figure 3:
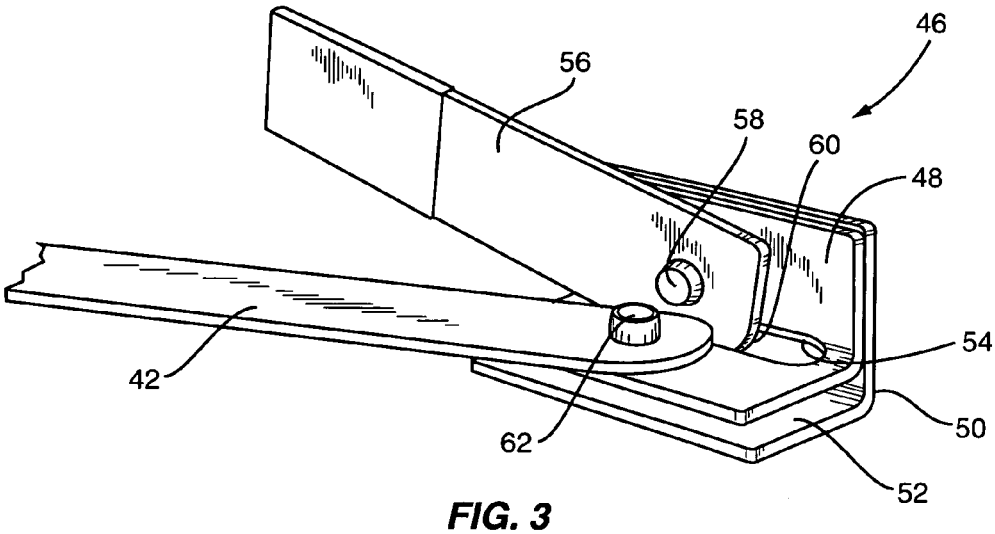
FIG. 3 is a fragmentary perspective view showing the fastening mechanism of the tensioner utilized to connect the tensioner to the metal strap.
Figure 4:
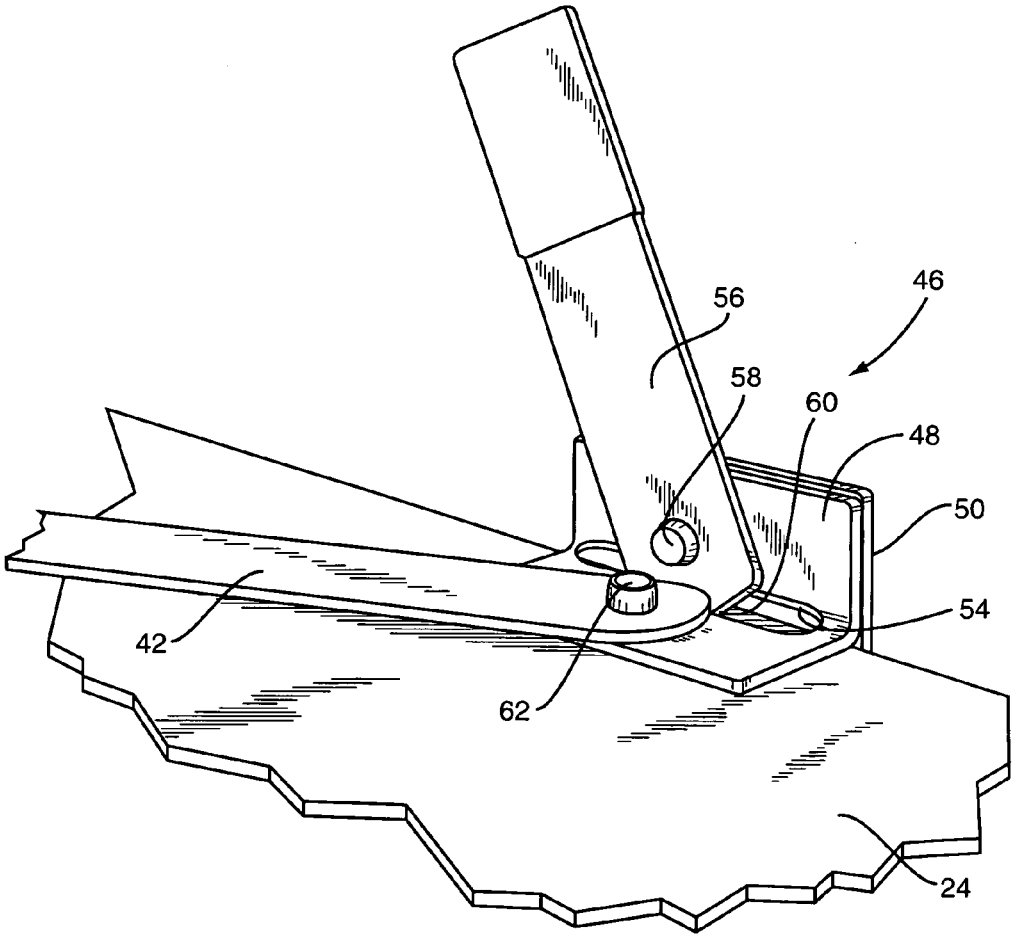
FIG. 4 is a fragmentary perspective view showing the fastener attached to a portion of the metal strap.

Secured to the terminal end of each link 42 and 44 is a fastener indicated generally by the numeral 46. Fastener 46 is designed to attach to a portion of the metal strap 24. Various fastener designs can be utilized to attach tensioner 40 to the strap 24. In the case of the embodiment illustrated in FIGS. 3 and 4, the fastener 46 includes a bracket structure that is made up of two L-shaped brackets 48 and 50. Brackets 48 and 50 are welded or secured together as illustrated in FIG. 3. When brackets 48 and 50 are secured together, there is defined an open space 52 between the lower portions of the brackets 48 and 50. See FIG. 3. Space 52 is designed to accommodate the thickness of the strap 24. In other words, strap 24 can be inserted into space 52. An opening 54 is provided in the lower portion of the inner bracket 48. A lever 56 is pivotally mounted by pivot pin 58 to the L-shaped brackets 48 and 50. Lever 56 includes a terminal end portion adjacent the pivot 58 that includes an engaging surface. Further, lever 56 is connected about the fastener such that the lower portion thereof aligns with the opening 54 in the inner bracket 48. Consequently, when lever 56 is rotated clockwise, as viewed in FIG. 3 and when a portion of the strap 54 is inserted into the space 52, it is seen that the lower engaging surface 60 of the lever 56 will engage a surface of the strap 54. As the lever 56 is continued to be rotated and turned, the lower engaging surface 60 will turn into engagement and contact with the strap 24 and will effectively pinch or secure the strap 24 in the space 52. It is further noted that each of the links 42 and 44 are pivotally connected to a respective fasteners 46 by pivot pin 62. This, of course, allows the fastener 46 to be adjusted with respect to the terminal end of the links 42 and 44.

Disposed about the opposite end of the tensioner 70 is a flexible cable 70. Cable 70 includes two ends. Secured to each end of the cable 70 is a connector 72. Connector 72 can assume various forms, but in the case of the embodiment illustrated herein, connector 72 assumes a generally Z-shape and is adapted to be secured into any one of the openings 22 formed in the upper and lower channels 12 and 14 within the corner areas 20. As will be appreciated from subsequent portions of the disclosure, the Z-shaped connector 72 can be inserted into an opening 22 and held therein.

Cable 70 is connected to a connector 80. Connector 80, in the case of this embodiment, is in the form of a plate, but it is understood that various types of structures can be utilized for the connector. Connector 80 includes a series of bent tabs 82 that define an area through which the cable 70 can be threaded. Effectively, tabs 82 retain the cable about the connector 80, but it is appreciated that the cable 70 can be adjusted with respect to the connector 82. That is, the cable 70 does not have to be fixed with respect to the connector 80.

Pivotally mounted to the connector 80 is a handle 90. Handle 90 is pivotally connected to the connector 80 via a pivot pin 92. Handle 90 can be moved between a first position shown in FIG. 1 and a second position shown in FIG. 2. As will be appreciated from subsequent portions of the disclosure, when the handle is moved from the first position in FIG. 1 to the second position in FIG. 2, the effective length of the tensioner will be decreased and in the process, because the fasteners 46 attach to the strap 44, the strap will be pulled tight or tensioned.

Extending between the handle and the first and second links 42 and 44, is a connecting link indicated generally by the numeral 100. As seen in the drawings, connecting link 100 is pivotally connected to both the handle 90 and the pair of links 42 and 44. More particularly, connecting link 100 is connected to the handle via pivot pin 102 and connected to the pair of links 42 and 44 via the pivot pin 104. It will be appreciated from subsequent portions of the disclosure, the connecting link 100 is extendable and retractable, and moves between an extended position and a retracted position. More particularly, the connecting link 100 includes a pair of links 106 and 108. In some cases link 106 is referred to as a third link while link 108 is referred to as a fourth link. Note that each link includes a stop. In the case of link 106 the same includes a turned end portion 106A that functions as a stop. Likewise, link 108 includes a turned end portion 108A that functions as a stop. Thus, it is appreciated that links 106 and 108 can move with respect to each other. This is because link 106 is pivotally connected directly to the handle 90 via pivot pin 102, while link 108 is pivotally connected to the pair of links 42 and 44.

Figure 5:
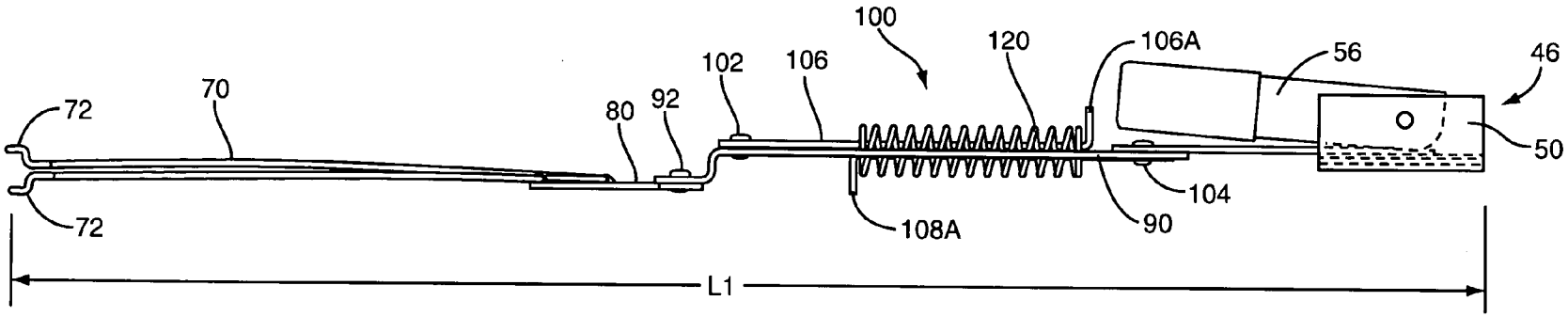
FIG. 5 is a side elevational view of the tensioner shown in the extended position.

Links 106 and 108, which constitute the connecting link 100, are held together by a coil spring 120. Note that opposed end portions of links 106 and 108 are threaded through the coil spring 120. Coil spring 120 is confined and held by the opposed stops 106A and 108A. When the links 106 and 108 assume their normal extended position, the coil spring is also extended. That is, the coil spring 120 biases the links 106 and 108 to the extended position, which is shown in FIG. 5.

Figure 2:
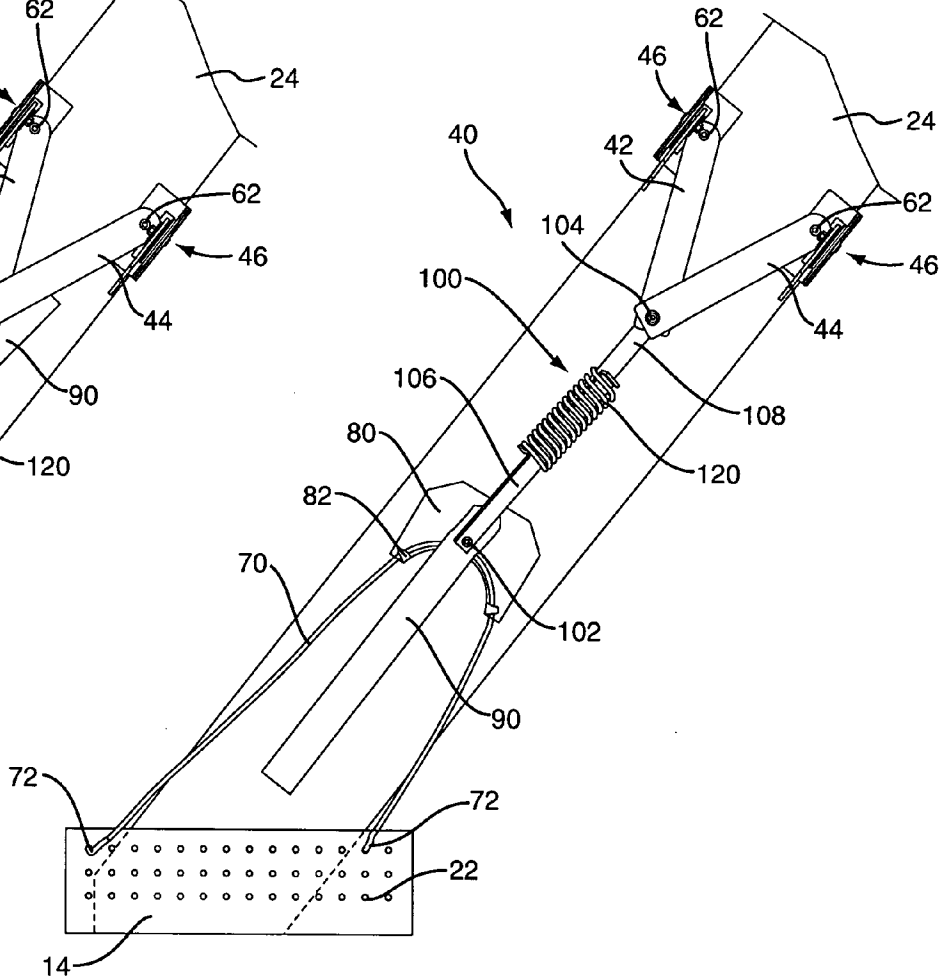
FIG. 2 is a view similar to FIG. 1 with the tensioner shown in the retracted position with the wall strap being tensioned.
Figure 1:
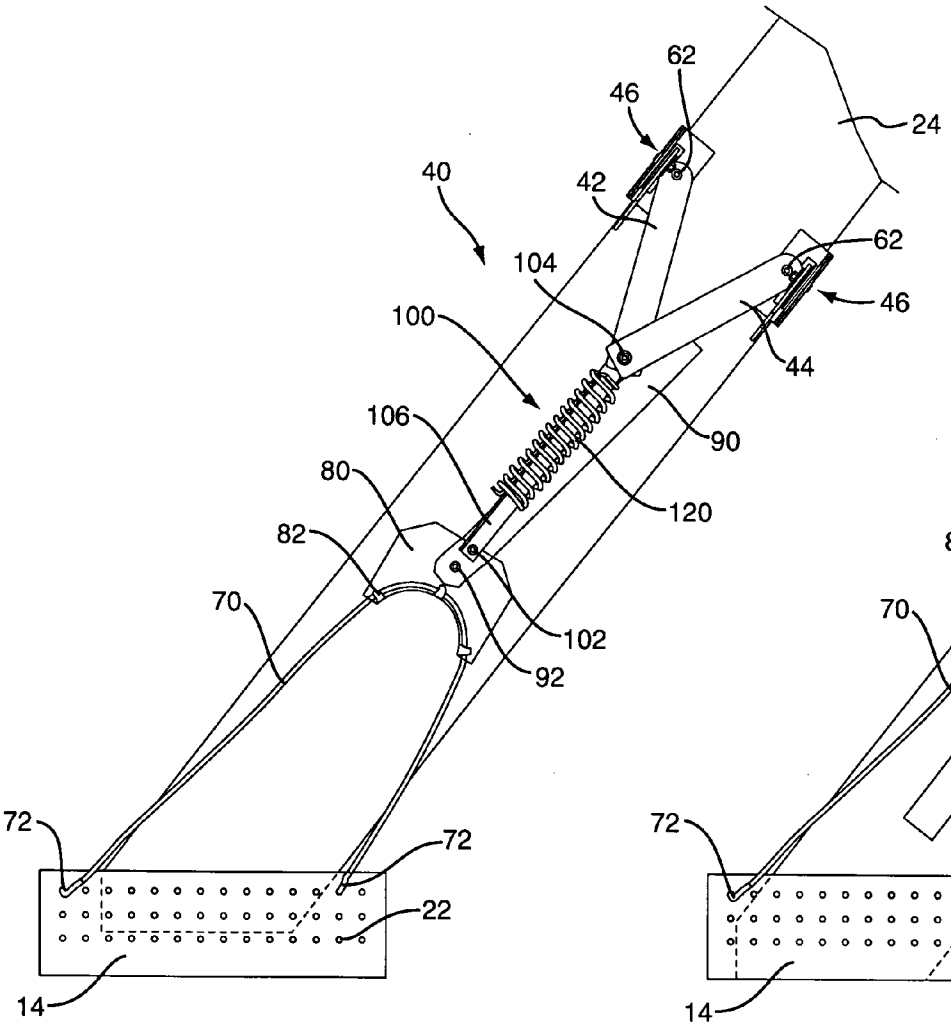
FIG. 1 a fragmentary side elevational view showing the wall strap tensioner of the present invention secured to a wall strap and disposed in the extended position.
Figure 6:
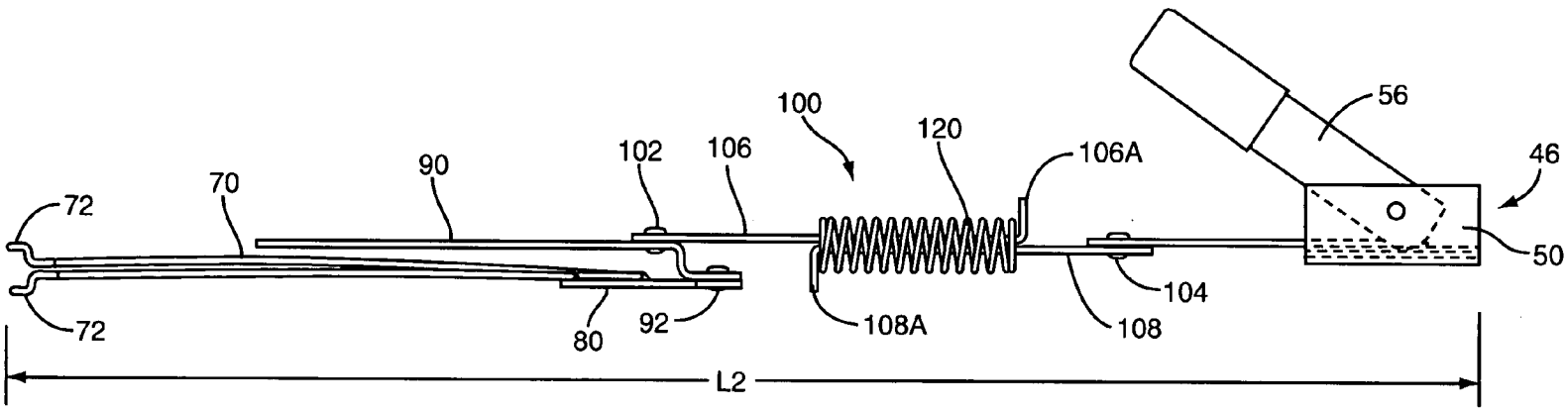
FIG. 6 is a side elevational view of the tensioner shown in the retracted position.

Links 106 and 108 are moved to the retracted position shown in FIG. 6 by rotating the handle 90 from the first position shown in FIG. 1 to the second position shown in FIG. 2. Note that as handle 92 is rotated clockwise, as viewed in FIG. 1, that the pivot pin 102 attaching the handle to link 106 tends to move generally downwardly and to the left, as viewed in FIG. 1, towards the section of the lower channel 14 that forms a part of the wall section 10. Thus, the connecting link 100 is pulled to the left, as viewed in FIGS. 5 and 6, when the handle 90 is rotated from the first position to the second position shown in FIG. 2. As the handle 90 is swung, it is appreciated that the stops 106A and 108A compress the spring 120. Even though the spring 120 is compressed, the net effect is that the connecting link, and its components 106 and 108, is moved right to left as viewed in FIGS. 5 and 6. Because of the presence of the coil spring 120, the link 108 may not move in a one-to-one correspondence with link 106. However, the strength of the spring 120 will still cause the link 108 to move right to left in FIGS. 5 and 6.

As the handle 90 is rotated, the effective length of the tensioner 40 will decrease. As shown in FIG. 5, in the extended position, the tensioner 40 includes a length L1. In the retracted position shown in FIG. 6, the tensioner 40 has a length L2. L2 is less than L1 and consequently this means that, the distance between the fasteners 46 and the connectors 72 will decrease in an application where a strap 24 is being tensioned.

Figure 8:
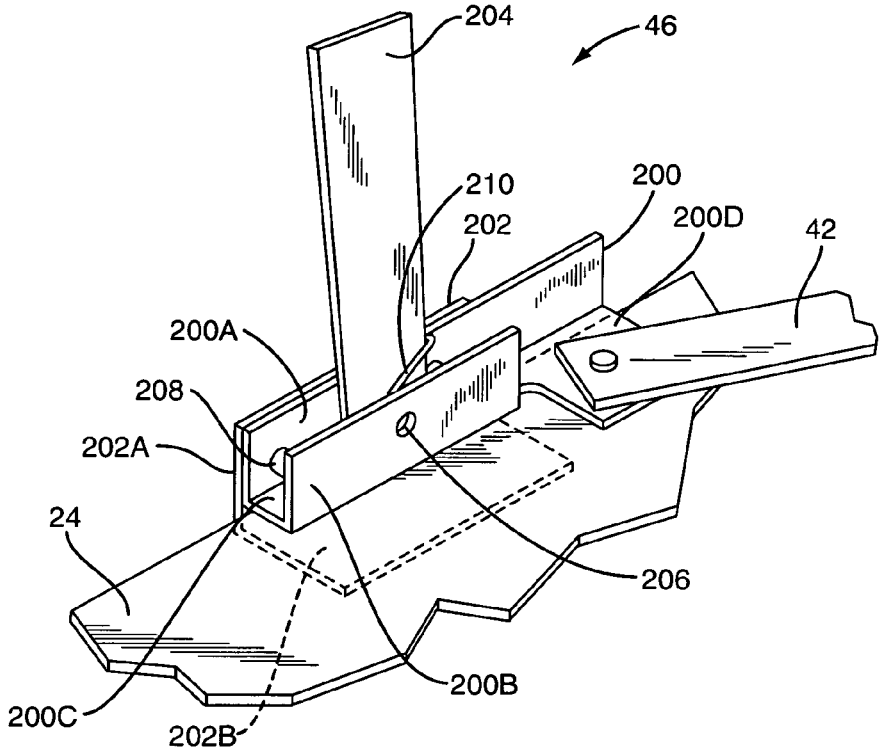
FIG. 8 is a fragmentary perspective view of an alternate design for the strap fastening mechanism.
Figure 9:
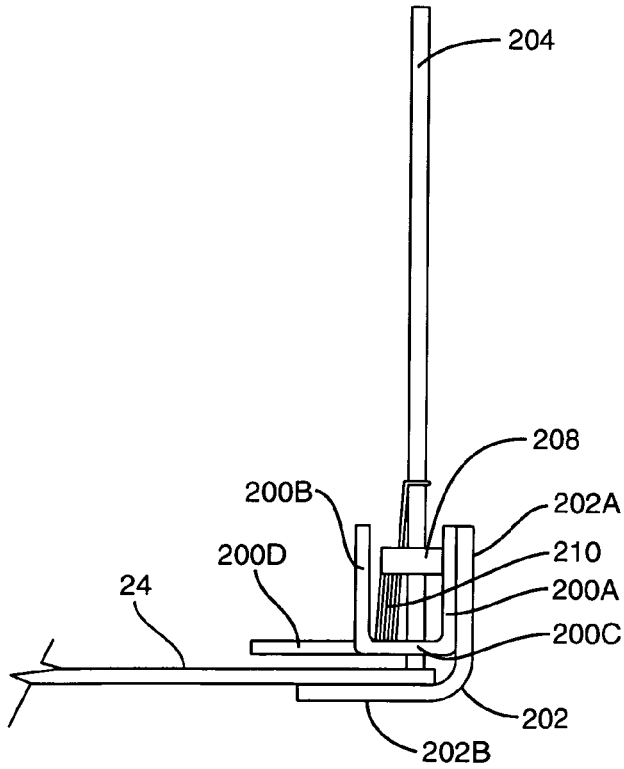
FIG. 9 is an end elevational view of the strap fastening mechanism of FIG. 8.

With reference to FIGS. 8 and 9, an alternate embodiment is shown for the fastener 46. As illustrated in FIG. 8, the fastener shown therein includes a first bracket 200. Bracket 200 includes a side 200A and a side 200B. Extending between the sides 200A and 200B is a bottom or lower portion 200C. Like the embodiment discussed above, the bottom 200C includes an opening. Projecting from side 200A, about one end portion of the bracket 200, is a tab 200D. Tab 200D is connected to link 42.

Secured to the first bracket 200 is a second bracket 202. Second bracket 202 includes a pair of sides 202A and 202B. A space is defined between the first bracket 200 and the second bracket 202. As with the prior embodiment, this space is operative to receive a portion of the strap 24.

Pivotally mounted to the first bracket 200 is a lever or handle 204. Lever 204 is pivotally mounted by a pivot pin 206. A pair of stops 208 are disposed on opposite sides of the pivot pin 200 and effectively limit the pivoting movement of lever 204. A spring 210 engages lever 204 and biases the same towards a locked or latched position. The form of spring 210 may vary, however in the case of the embodiment illustrated in FIGS. 8 and 9, the spring 210 is the form of a tortional spring and is disposed so as to engage lever 204 and to bias the same to a position where the lower terminal end of the lever will engage and pinch the strap 24 so as to secure the strap between the lower terminal edge of the lever 204 and the bottom 202B of the second bracket 202. It follows that the fastener 46 can be released from the strap 204 by pivoting the lever 204 downwardly against the bias of the spring 210.

FIGS. 1 and 2 illustrate how the tensioner 40 is used. First, one end portion, not shown in FIGS. 1 and 2, of the strap 24 is attached to a corner area 20 of the metal wall 10. Next the tensioner 40 is secured to an opposed end portion of the strap 24. This is illustrated in FIG. 1. Fasteners 46 are clamped or secured to opposite edges of the strap 24 a short distance from the end portion thereof, as shown in FIG. 1. Next, the connectors 72 formed on the end of the cable 70 are inserted into two openings 22 formed in the lower track 14 in the corner area 20 of the metal wall section 10. This is illustrated in FIG. 1. The lower left portion of the strap 24, as viewed in FIG. 1, is unattached. Then, the handle 90 is swung clockwise from the position shown in FIG. 1 to the position shown in FIG. 2. This causes the connecting link 100 to pull links 42 and 44, which in turn pull fasteners 46 towards the lower left hand corner of the metal wall 10. This effectively pulls the strap 24 tight, and once the handle 90 assumes the position shown in FIG. 2, then the end portion of the strap 24 can be screwed or otherwise connected to the lower track 14. In some cases, it is appreciated that the tensioner 40 can be used in stages to progressively increase the tension of the strap 24. That is, a first operation can be utilized to stretch the strap 24 and the strap can be secured at the end adjacent the tensioner 40. Then the tensioner 40 can be reset and the strap tensioned again, and after this stage or phase, the prior connection can be disconnected and reconnected to secure the strap in a tight configuration.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of tensioning a wall strap on a metal wall with a tensioner, comprising:

a. securing a first wall strap portion to a first portion of the metal wall;

b. mounting a tensioner by:

i. attaching a first portion of the tensioner to the wall strap and ii. attaching a second portion of the tensioner, which is spaced from the first portion of the tensioner by a distance, to an anchoring structure;

c. tensioning the wall strap by reducing the distance between the first and second portions of the tensioner;

d. after tensioning the wall strap, securing the wall strap to a second portion of the metal wall that is spaced from the first portion of the metal wall;

e. after securing the wall strap to the second portion of the metal wall, disengaging the tensioner by:

i. detaching the first portion of the tensioner from the wall strap, and ii. detaching the second portion of the tensioner from the anchoring structure;

f. leaving the wall strap tensioned and secured to both the first and second portions of the metal wall after disengaging the tensioner.

2. The method of claim 1 wherein the anchoring structure includes a corner area portion of the metal wall.

3. The method of claim 2 wherein the corner area portion of the metal wall includes a structure having a series of openings formed therein and wherein attaching the second portion of the tensioner includes connecting the tensioner to the openings in the corner area of the metal wall.

4. The method of claim 1 wherein reducing the distance between the first and second positions of the tensioner includes actuating the tensioner by moving a handle from a first position to a second position.

5. The method of claim 1 wherein the second portion of the tensioner includes a cable, and wherein the method includes connecting the cable to the anchoring structure.

6. The method of claim 5 including connecting the cable to the anchoring structure includes securing the cable to openings in a plate comprised in the anchoring structure.

7. The method of claim 1 wherein attaching a first portion of the tensioner to the wall strap includes utilizing two fasteners that engage and pinch the strap.

8. The method of claim 1 including collapsing the tensioner and utilizing a spring to bias against the tensioner being collapsed.

9. The method of claim 1 including a cable that attaches to the metal wall and wherein the tensioner includes first and second links that include fasteners for attaching to the wall strap; and wherein reducing the distance between the first and second positions of the tensioner includes shortening the tensioner by moving a handle from a first position to a second position.

10. The method of claim 1 including attaching the first portion of the tensioner to the wall strap by securing fasteners to the wall strap and to first and second links disposed about the first portion of the tensioner; and attaching the second portion of the tensioner to the anchoring structure by connecting two ends of a flexible cable that is included on the tensioner to the anchoring structure.

11. The method of claim 10 including reducing the distance between the first and second portions of the-tensioner by moving a handle from a first position to a second position, and moving a connecting link that extends between the cable and the first and second links toward the anchoring structure.

12. The method of claim 1 wherein the tensioner includes a compound linkage having first and second end portions; one or more fasteners disposed on the first end portion for fastening to the metal strap; the second end portion including one or more connectors for connecting the compound linkage to the anchoring structure; the compound linkage being movable between a retracted and extended position; and an actuator for moving the connecting linkage such that a spacing between the fasteners disposed on the first end portion of the tensioner and the connector disposed on the second end portion of the tensioner is reduced.

13. The method of claim 10 wherein the anchoring structure includes a corner area portion of the metal wall, and wherein connecting the two ends of the flexible cable to the anchoring structure includes connecting the two ends to openings formed in the corner area portion of the metal wall.

14. A method of tensioning a wall strap of a metal wall with a tensioner, comprising:

a. attaching one portion of the tensioner to the wall strap;

b. attaching a second portion of the tensioner to a portion of the metal wall other than the strap;

c. shortening the effective length of the tensioner by shortening the distance between where the first portion of the tensioner attaches to the wall strap and where the second portion of the tensioner attaches to the metal wall, thereby tensioning the wall strap; and d. after tensioning the wall strap, securing the wall strap to the metal wall;

e. wherein the second portion of the tensioner is secured to a corner area portion of the metal wall; and f. wherein the corner portion of the metal wall includes a structure having a series of openings formed therein and wherein the second portion of the tensioner is connected to the openings in the corner area of the metal wall.

15. A method of tensioning a wall strap of a metal wall with a tensioner, comprising:

a. attaching one portion of the tensioner to the wall strap;

b. attaching a second portion of the tensioner to a portion of the metal wall other than the strap;

c. shortening the effective length of the tensioner by shortening the distance between where the first portion of the tensioner attaches to the wall strap and where the second portion of the tensioner attaches to the metal wall, thereby tensioning the wall strap; and d. after tensioning the wall strap, securing the wall strap to the metal wall;

e. wherein the tensioner includes first and second links disposed about one end portion of the tensioner and a flexible cable disposed about the other end of the tensioner; and wherein the cable includes two ends that are attached to a corner area of the metal wall while fasteners secured to the first and second links are secured to the strap.

16. The method of claim 15 including a handle and a connecting link that extends between the first and second links and the cable, and wherein the method entails moving the handle from a first position to a second position which causes the connecting link to be moved toward the corner area of the metal wall where the cable is connected thereto, thereby decreasing the effective link of the tensioner and tensioning the strap in the process.

17. The method of claim 16 wherein the tensioner includes a compound linkage having first and second end portions; one or more fasteners disposed on the first end portion for fastening to the metal strap; the second end portion including one or more connectors for connecting the compound linkage to a structure other than the strap; the compound linkage being movable between a retracted and extended position; and an actuator for moving the connecting linkage such that the distance between the fasteners disposed on the first end portion of the tensioner and the connector disposed on the second end portion of the tensioner is reduced.

* * * * *